US010388261B1

(12) United States Patent
Ross, IV

(10) Patent No.: US 10,388,261 B1
(45) Date of Patent: Aug. 20, 2019

(54) STRINGED MUSICAL INSTRUMENT BRIDGE

(71) Applicant: R. Aaron Ross, IV, Springfield, MO (US)

(72) Inventor: R. Aaron Ross, IV, Springfield, MO (US)

( * ) Notice: Subject to any disclaimer, the term of this patent is extended or adjusted under 35 U.S.C. 154(b) by 33 days.

(21) Appl. No.: 15/663,001

(22) Filed: Jul. 28, 2017

Related U.S. Application Data

(60) Provisional application No. 62/367,681, filed on Jul. 28, 2016.

(51) Int. Cl.
*G10D 3/04* (2006.01)
*G10D 3/12* (2006.01)

(52) U.S. Cl.
CPC ..... *G10D 3/04* (2013.01); *G10D 3/12* (2013.01)

(58) Field of Classification Search
None
See application file for complete search history.

(56) References Cited

U.S. PATENT DOCUMENTS 4,366,740 A 1/1983 Tripp ..... 84/298
4,453,443 A * 6/1984 Smith ..... G10D 3/12 84/205
4,688,461 A * 8/1987 Stroh ..... G10D 3/12 84/267
4,724,737 A * 2/1988 Fender ..... G10D 3/146 84/297 R
6,124,536 A * 9/2000 Hoshino ..... G10D 3/04 84/298
2002/0092404 A1* 7/2002 Naimish ..... G10D 3/04 84/298
2003/0177883 A1* 9/2003 Rose ..... G10D 3/04 84/298
2004/0159204 A1 8/2004 Rose ..... 84/298
2005/0150347 A1* 7/2005 Hannes ..... G10D 3/04 84/297 R

FOREIGN PATENT DOCUMENTS

JP 10149155 A * 6/1998
WO WO-2008022037 A2 * 2/2008 ..... G10D 3/04

* cited by examiner

*Primary Examiner* — Daniel J Colilla
(74) *Attorney, Agent, or Firm* — Jonathan A. Bay

(57) ABSTRACT

A bridge for a stringed musical instrument has a plurality of bridge-adjusting assemblies, one each for each string of the musical instrument. Each bridge-adjusting assembly has an anchorage seat for the terminal tackle of the respective string, as well an anchorage-seat height-adjusting sub-assembly and an anchorage-seat intonation-adjusting sub-assembly. All these are assembled in or on a base plate for mounting on the top of the stringed musical instrument, or in a pocket in the top of the string musical instrument.

9 Claims, 14 Drawing Sheets

STRINGED MUSICAL INSTRUMENT BRIDGE

CROSS-REFERENCE TO PROVISIONAL APPLICATION(S)

This application claims the benefit of U.S. Provisional Application No. 62/367,681, filed Jul. 28, 2016, the disclosure of which is incorporated herein by this reference thereto.

BACKGROUND AND SUMMARY OF THE INVENTION

The invention relates to bridges for stringed musical instruments.

It is an aspect of the invention that, and without limitation, this improvement to bridges was developed in connection with a project for an electric bass guitar.

However, the bridge in accordance with the invention can be utilized in connection with a multiplicity of other stringed musical instruments including without limitation electric guitars other than bass electric guitars, acoustic guitars, cello, double bass (ie., stand-up acoustic bass violins) and so on.

FIGS. 10 and 11 show a bridge in accordance with the prior art, which has saddles for the strings. Each string lies on or sits in a respective groove in the saddle where that string crosses the saddle. It is an issue that the saddle forms a bend or kink in the string.

It is an aspect of the invention to provide improvements over the prior art.

A number of additional features and objects will be apparent in connection with the following discussion of the preferred embodiments and examples with reference to the drawings.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the skills of a person having ordinary skill in the art to which the invention pertains. In the drawings.

FIG. 5C shows a bullet-style end, and unseated away from its seat like FIG. 5A;

DETAILED DESCRIPTION OF THE PREFERRED EMBODIMENTS

Figure 1:
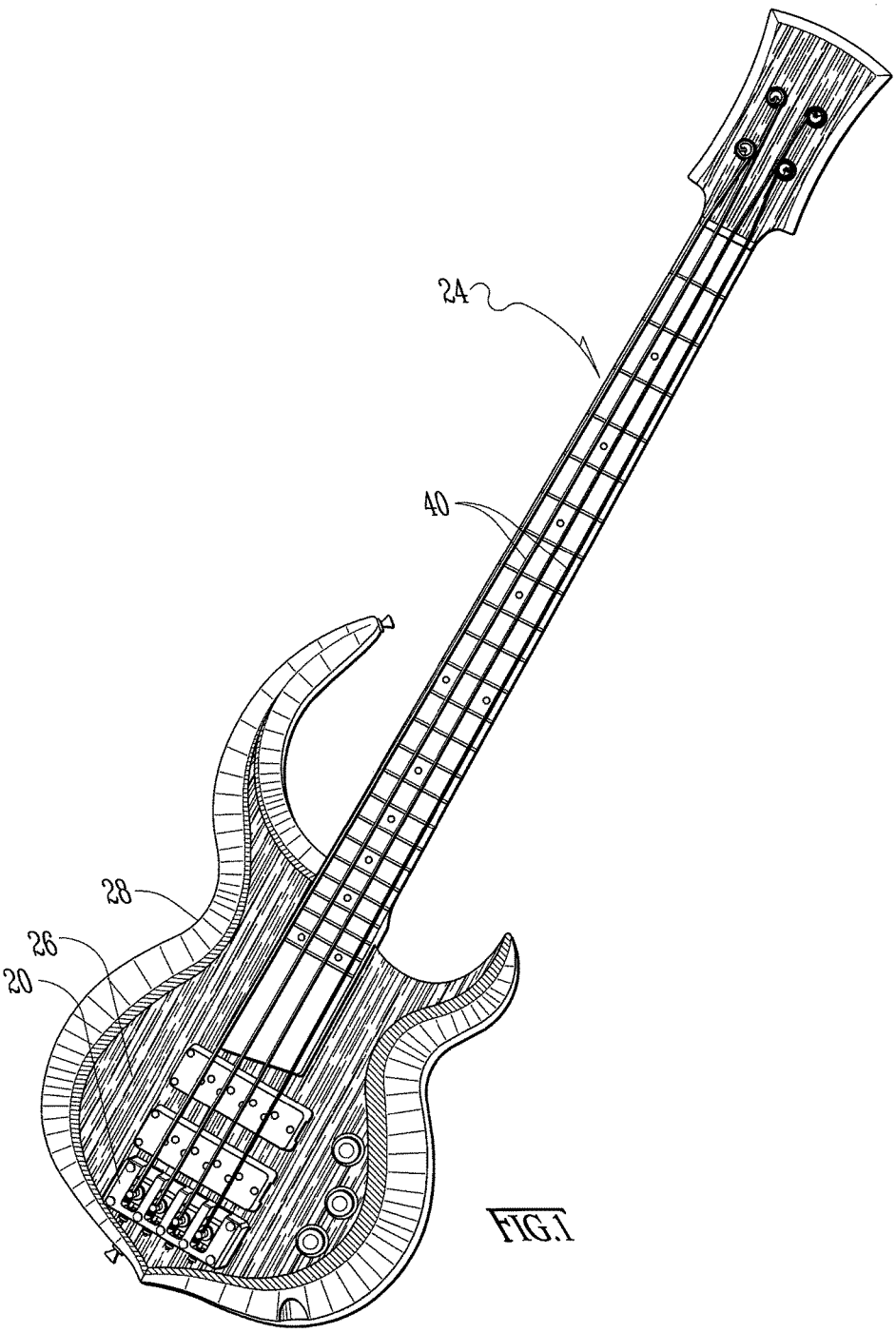
FIG. 1 is a perspective view of an electric bass guitar provided with a bridge in accordance with the invention for stringed musical instruments.

FIGS. 1 through 7 show a first embodiment of a bridge in accordance with the invention for stringed musical instruments 24.

The bridge comprises a base plate 30 mounted on the top side 26 of the body 28 of a stringed musical instrument 24. In theses drawings, the example musical instrument 24 is shown as (for example and without limitation) an electric bass guitar 24. In this example, the base plate 30 is a top-mount style as the base plate 30 is mounted on the top side 26 of the guitar 24. The mounting is shown achieved by, for example and without limitation, by screws.

Figure 2:
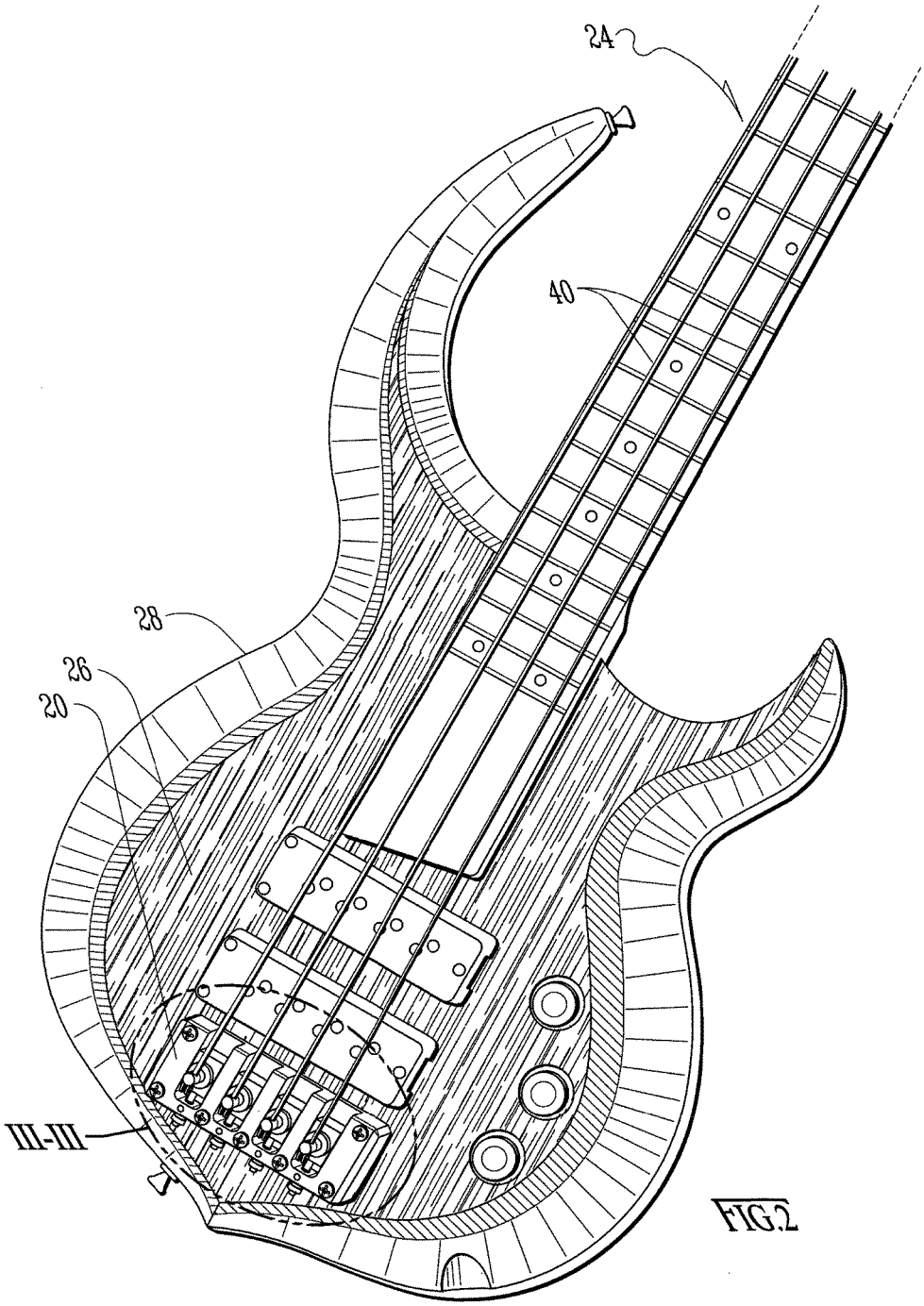
FIG. 2 is an enlarged perspective view of the body of the guitar shown in FIG. 1.
Figure 3:
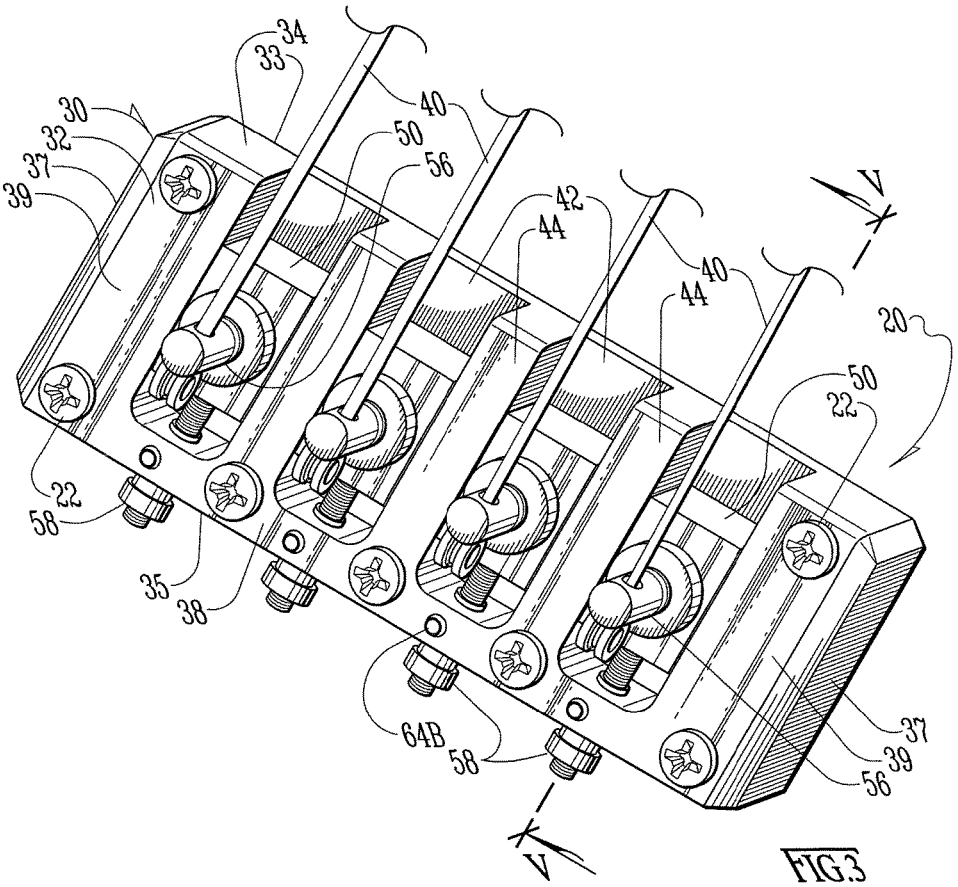
FIG. 3 is an enlarged-scale perspective view of detail in FIG. 2, showing the bridge and the bridge-ends of the strings in isolation, with other portions of the strings broken away.

Pause can be taken to discuss a preliminary matter. And that is, setting forth the terminology that will preferably be consistently used herein regarding spatial directions. Thus, the side of the body 28 of the guitar 24 facing up in the views of FIGS. 1 and 2 is conventionally referred to as the "top" side, or "top" surface. The opposite side, which when the guitar 24 is being played would be alongside the musician, would be the "back" side. Hence this convention establishes the "top" to "back" direction as used herein. Accordingly, the base plate 30 has a "top" side 32 and "back" side 33. The side 34 of the base plate 30 from which the instrument strings 40 extend out therefrom, is the "front" side 34. The opposite side 35 is the "rear" side 35. So that establishes front to rear. The spaced sides 37 of the base plate 30 which are parallel to the axes of the instrument strings 40 are "lateral" sides 37.

Accordingly, the base plate 30 has spaced apart top and back sides 32 and 33, spaced apart front and rear sides 34 and 35, as well as spaced apart lateral sides 37. The base plate 30 further has a rear wall 38, and spaced lateral shoulders 39 (eg., spaced lateral walls). Whereas the drawings show the base plate 30 machined out of a monolithic block of metal (preferably stainless or brass), it could be produced of other materials, and/or, assembled from parts (but this not shown).

The base plate 30 has four slots 42 formed in its top side 32. The four slots 42 correspond to the four strings 40 for this base guitar 24. The slots 42 are closed-ended at the rear wall 38 of the base plate 30 but are open through the front side 34. The slots 42 are separated by laterally-spaced partitions 44. The outer two slots 42 are bracketed by the laterally-spaced shoulders 39. Each slot 42 serves as a slide pathway for one bridge-adjustment assembly 50.

Each bridge-adjustment assembly 50 comprises a traveling slide block 52. Each traveling slide block 52 is confined to travel forward and rearward in its respective slot 42 therefor. Each block 52 has a top side 53 and rear side 54. The top side 53 supports a height-adjusting sub-assembly 56. The rear side 54 is coupled to an intonation-adjusting sub-assembly 58.

Figure 4:
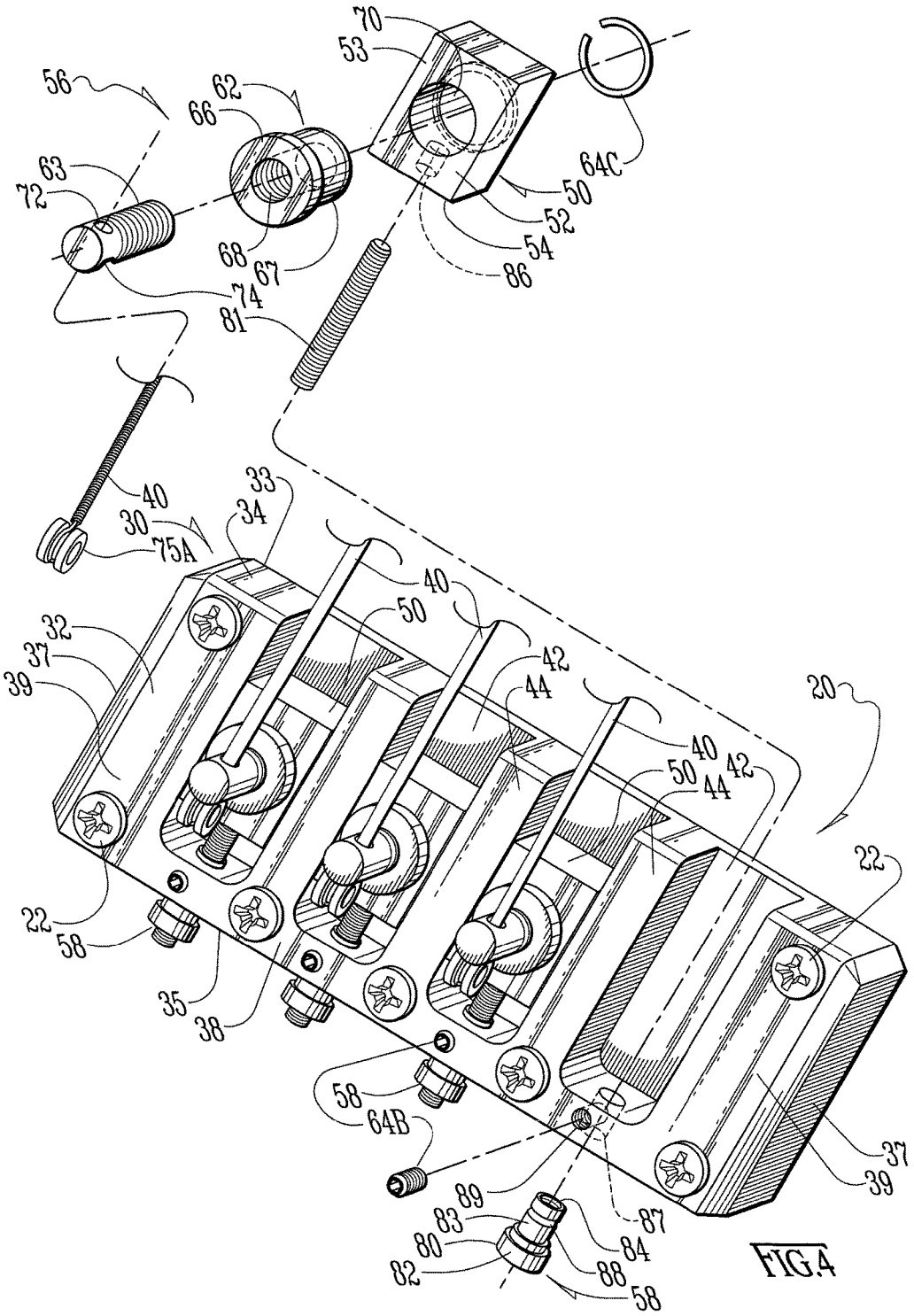
FIG. 4 is a perspective view comparable to FIG. 3 except with one of the four bridge-adjustment assemblies shown exploded.
Figure 5A:
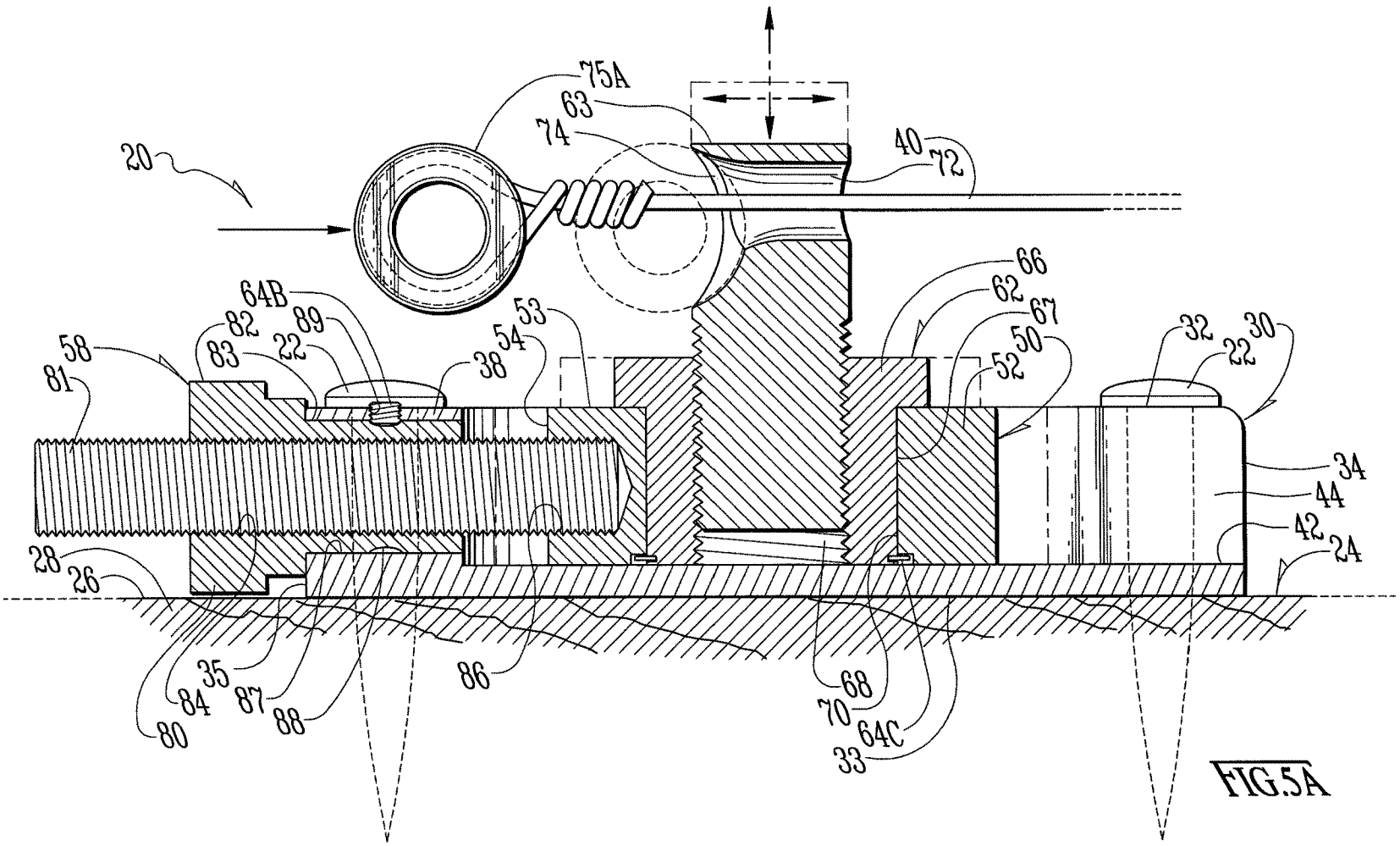
FIG. 5A is an enlarged-scale sectional view generally taken along line V-V in FIG. 3, except wherein the ball-end bead of the musical instrument string is shown unseated away from its seat.
Figure 5B:
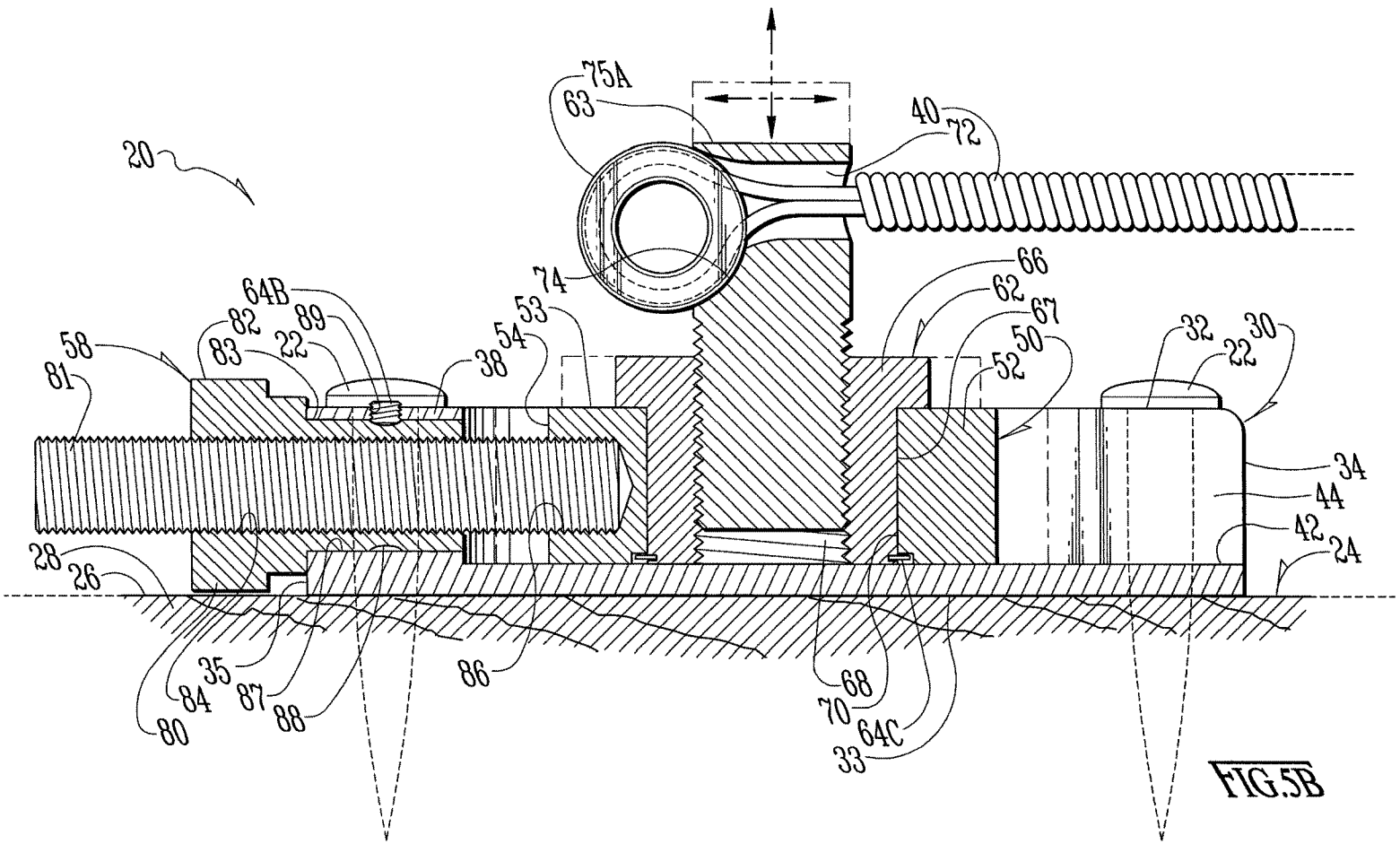
FIG. 5B is a sectional view comparable to FIG. 5A except showing the ball-end bead of the string seated in its seat.
Figure 5C:
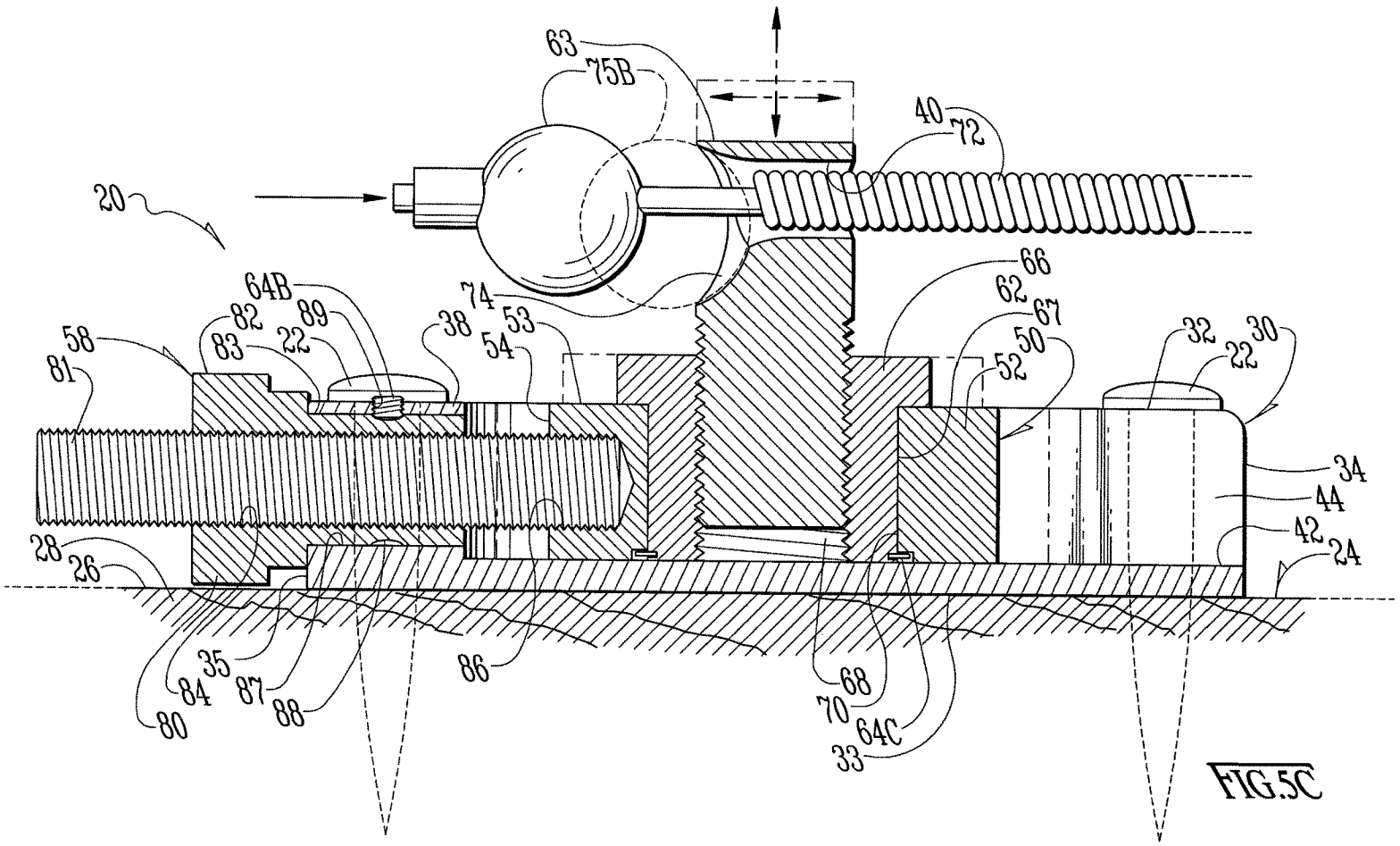
FIG. 5C is a sectional view comparable to FIG. 5A except—instead of showing a ball-end bead style of an end for a musical instrument string—this
Figure 5D:
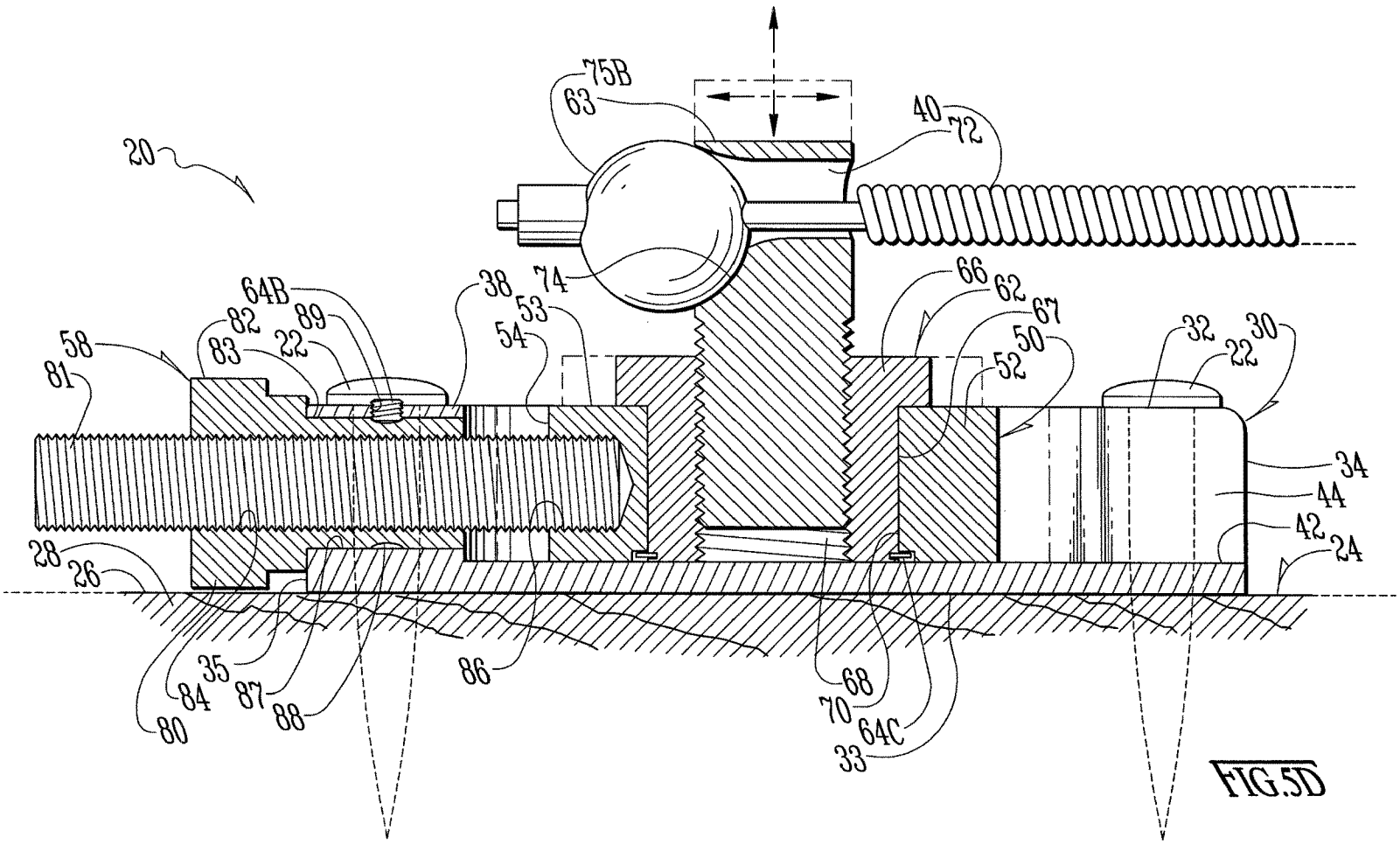
FIG. 5D is a sectional view comparable to FIG. 5C except showing the bullet end of the string seated in its seat.
Figure 6:
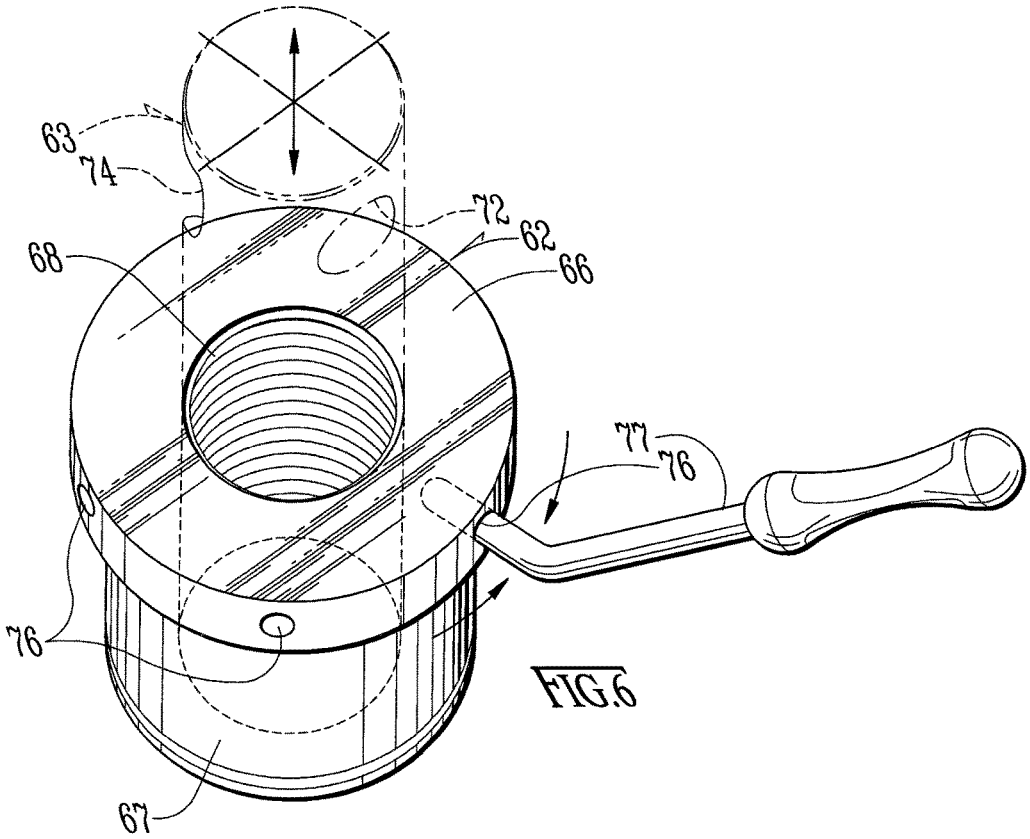
FIG. 6 is an enlarged-scale perspective view of a height-adjusting bushing for one of the bridge-adjustment assemblies in accordance with the invention, and provided with sockets for being turned by a pin wrench therefor.

FIGS. 4-6 show better an example construction of the height-adjusting sub-assembly 56. That is, the height-adjusting sub-assembly 56 comprises a height-adjusting bushing 62, an anchor pin 63, and a bushing-retention provision 64 in the form of (for example and without limitation) a snap-in retaining ring 64A.

The height-adjusting bushing 62 has an enlarged flange head 66 and a smaller-diameter cylindrical barrel portion 67. The height-adjusting bushing 62 is provided with an internally-threaded through-hole 68 through its top and bottom ends.

Now to turn to the block 52, it has a smooth bore aperture 70 through its top and bottom sides. The barrel portion 67 of the height-adjusting bushing 62 drops into the smooth bore aperture 70 of the block 52 until its enlarged flange head 66 more or less rests on the top side 53 of the block 52.

The block 52 furthermore has formed in its smooth bore central aperture, an internal ring groove near its bottom. The height-adjusting bushing 62 correspondingly has formed on the outside of the barrel portion 67 a like ring groove near the bottom of the barrel portion 67. The two ring grooves can be aligned opposite each other at the same elevation with respect to each other. The snap-in retainer ring 64A can be snapped in to span between the two grooves, and thereby axially locking the height-adjusting bushing 62 and block 52 together. However, the height-adjusting bushing 62 is free to spin in the block 52, even if the height-adjusting bushing 62 is axially locked in the block 52.

The anchor pin 63 is generally cylindrical and is formed with external thread over most of its bottom half. The top of the anchor pin 63 is formed with a diametrical through-hole 72 which, in use, will be oriented on a front to rear axis. This through-hole 72 is a string hole 72. The string 40 of the musical instrument 24 is threaded through this string hole 72. The rear of the string hole 72 is formed with a ball seat 74.

FIG. 5A shows the ball-end bead 75A of an instrument string 40 unseated away from the seat 74. In contrast, FIG. 5B shows the ball-end bead 75A of the string 40 seated in the seat 74. To turn to bullet-style string ends 75B, FIG. 5C shows a bullet-style string end 75B unseated away from the seat 74. FIG. 5D shows the bullet end 75B of the string 40 seated in the seat 74.

The anchor pin 63 threads into the internally-threaded hole 68 in the height-adjusting bushing 62. In use, twisting the height-adjusting bushing 62 clockwise or counterclockwise relative the block 52 which cannot rotate (and not about any axis, but particularly in this case not about a top to back axis) causes the anchor pin 63 to thread deeper into or rise out of the height-adjusting bushing 62. This thereby causes the string hole 72 to adjust in elevation between a low elevation extreme and a high elevation extreme.

Hence the flanged head 66 of the height-adjusting bushing 62 serves as a dial to change string 40 elevation relative the electronic pick-ups 90 of this electronic base guitar 24 (or, more generally, relative the top side 26 of the stringed musical instrument 24, including sound hole(s) of acoustic stringed musical instruments 24). From a musician's standpoint, high elevation strings 40 are generally harder to play. A low elevation strings 40, while generally more comfortable to play, can lead to other unwanted effects like fret buzz or string noise and so on.

Hence it is an advantage of the invention to provide string-height adjustability according to the subjective preference of the musician.

Again, the flanged head 66 of the height-adjusting bushing 62 serves as a dial to change string 40 elevation. The flanged head 66 can be formed as a hex head to accept hex wrenches, or be formed with one or two flats to accept crescent wrenches or the like (none of which is shown). In FIG. 6, the flange head 66 is cylindrical and formed with a series of sockets 76 for accepting a pin wrench 77, as shown.

FIGS. 4-5D and 7 show better an example construction of the intonation-adjusting sub-assembly 58. That is, the intonation-adjusting sub-assembly 58 comprises another bushing 80, a drive screw 81, and another bushing-retention provision 64 in the form of a set screw 64B, or roll pin or 64C, as described below in connection with FIGS. 9A and 9B, something else.

The intonation-adjusting bushing 80 has an enlarged flange head 82 and a smaller-diameter generally barrel portion 83. The flange head 82 for the intonation-adjusting bushing 80 in FIGS. 1-7 is actually stepped, but that is not strictly necessary. In use, the intonation-adjusting bushing 80 is aligned on a front to rear axis, and is provided with an internally-threaded through-hole 84 through its front and rear ends. To turn to the block 52, it has an internally-threaded hole 86 in its rear side. The drive screw 81, in use, is likewise aligned on a front to rear axis, and extends between a front end and rear end. The front end of the drive screw 81 is twisted tight into the internally-threaded hole 86 in the rear side of the block 52. Preferably some thread locking compound is spread on the threads of the front end of the drive screw 81 to ensure a more or less permanent fastening between the drive screw 81 and the block 52.

The rear wall 38 of the base plate 30 is formed with a smooth bore through-hole 87 that likewise aligns on a front to rear axis. The barrel portion 83 of the intonation-adjusting bushing 80 slides into this smooth bore aperture 87 of the rear wall 38 of the base plate 30 until its enlarged flange head 82 more or less rests against the rear wall 38 of the base plate 30.

The intonation-adjusting bushing 80 has formed on the outside of the barrel portion 83 a ring groove 88 at about the waist of the barrel portion 83 (eg., middle). The top side 32 of the rear wall 38 of the base plate 30 has correspondingly formed in it an internally-threaded through-hole 89 intersecting the smooth-bore through-hole 87 in the rear wall 38 of the base plate 30 which accepts the barrel portion 83 of the intonation-adjusting bushing 80.

The ring groove 88 on the barrel portion 83 of the intonation-adjusting bushing 80 can be aligned under the internally-threaded through-hole 89 in the top side 32 of the rear wall 38 of the base plate 30. This allows a set screw 64B to be twisted in such hole 89, to project into the ring groove 88 in the barrel portion 83 of the intonation-adjusting bushing 80, and thereby axially-lock the intonation-adjusting bushing 80 in place while still allowing the intonation-adjusting bushing 80 to spin. Again, the intonation-adjusting bushing 80 is free to spin in the rear wall 38 of the base plate 30, even if the intonation-adjusting bushing 80 is axially locked in place in the rear wall 38 of the base plate 30.

In use, twisting the intonation-adjusting bushing 80 clockwise or counterclockwise causes the drive screw 81 to pull the sliding block 52 rearward or push the sliding block 52 forward.

Hence the flanged head 82 of the intonation-adjusting bushing 80 serves as a dial to change the distance of the terminal tackle ends 75 of the string(s) 40 from the electronic pick ups 90 (or, for acoustic instruments, the sound hole or sound holes). From a musician's standpoint, intonation is a highly subjective preference. Accordingly, it is an aspect of the invention to provide intonation adjustability.

Hence it is an advantage of the invention to provide intonation adjustability according to the subjective preference of the musician.

Figure 7:
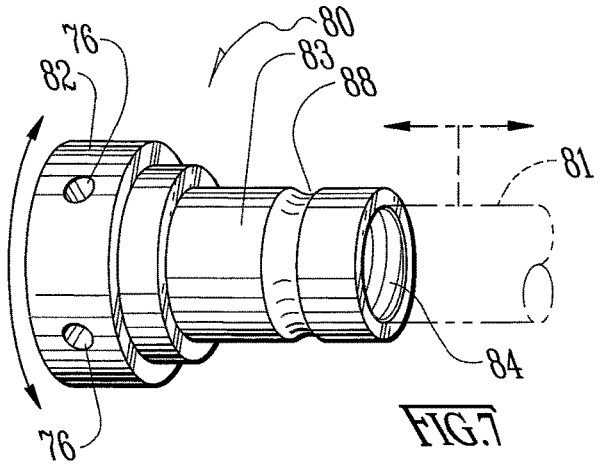
FIG. 7 is an enlarged perspective view of an intonation-adjusting bushing for one of the bridge-adjustment assemblies in accordance with the invention, and likewise provided with sockets for being turned by the pin wrench.

Again, the flanged head 82 of the intonation-adjusting bushing 80 serves as a dial to adjust the distance between the terminal tackle end(s) 75 of the string(s) 40 and the pick-ups 90 (or sound holes) of the respective stringed musical instrument 24. The enlarged flange head 82 can be formed as a hex head to accept hex wrenches, or one or two flats to accept crescent wrenches (none of which is shown). In FIG. 7, the flange head 82 is cylindrical and formed with a series of sockets 76 for accepting the pin wrench 77.

Figure 8A:
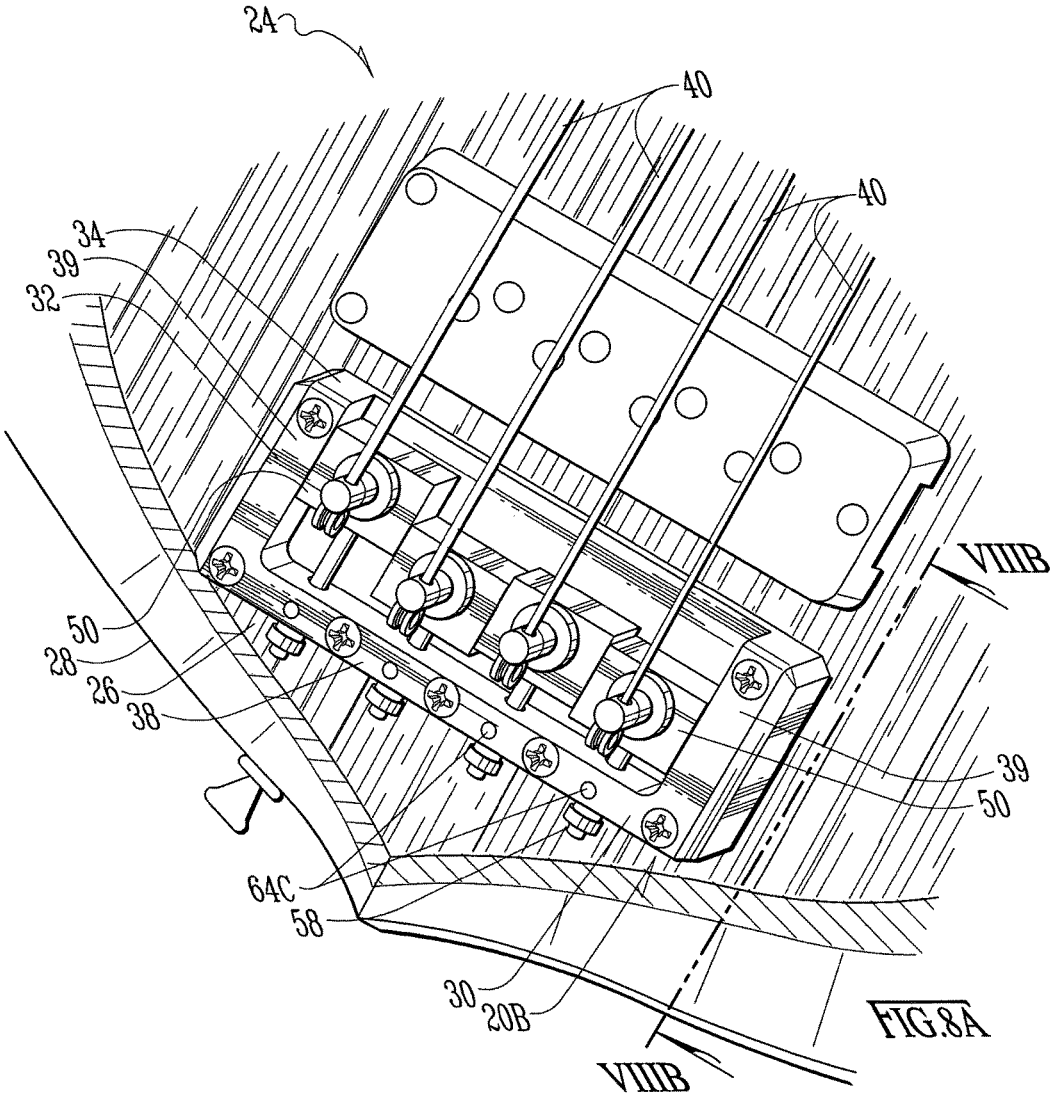
FIG. 8A is a perspective view comparable to FIG. 2 except on an enlarged scale and showing an alternate embodiment of a bridge in accordance with the invention for stringed musical instruments, wherein this embodiment—rather than having separate dedicated slots divided by partitions for the plural bridge-adjustment assemblies to slide in—this embodiment has eliminated the partitions in favor of a single common cavity for all the plural bridge-adjustment assemblies, which slide longitudinally past each other shoulder-to-shoulder.
Figure 8B:
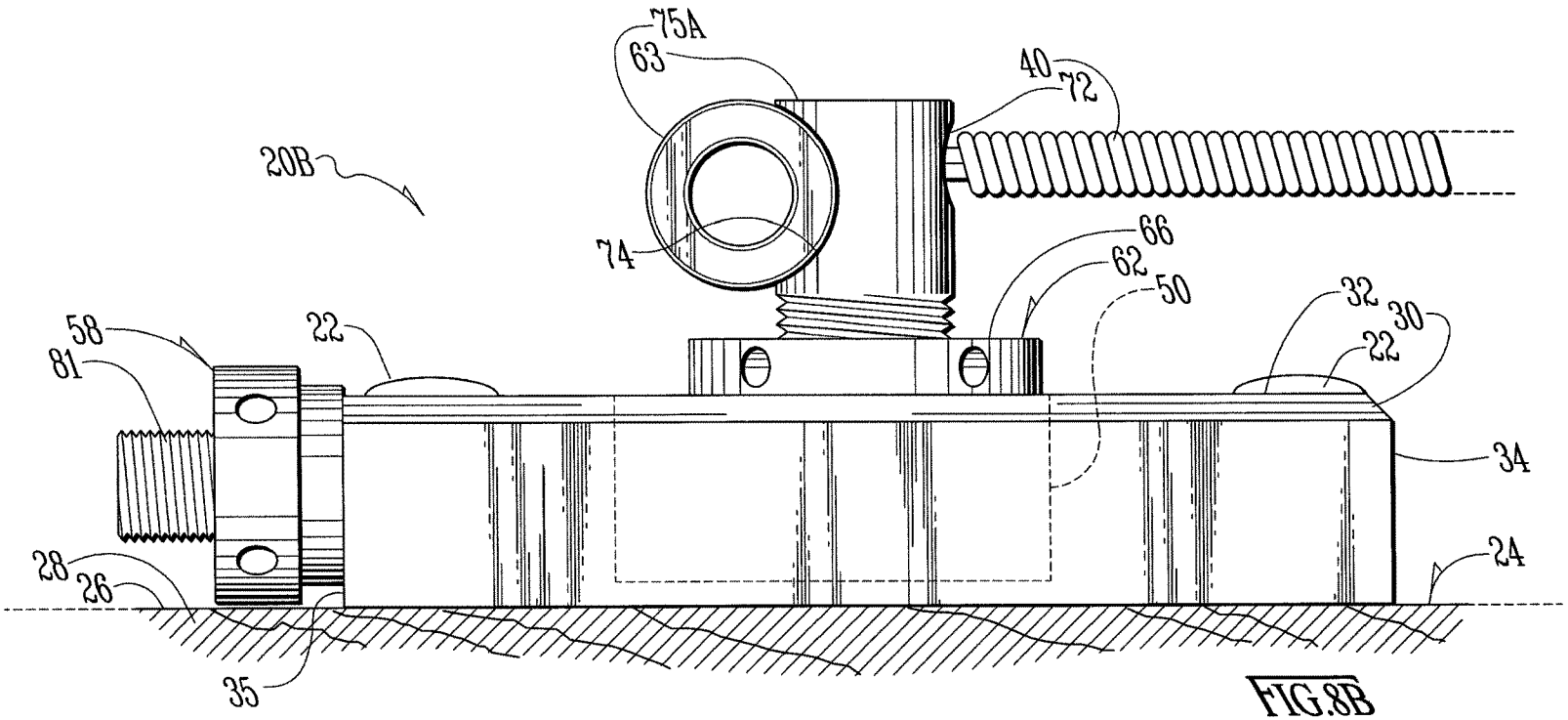
FIG. 8B is an enlarged-scale side elevational view taken in the direction of arrows VIIIB-VIIIB in FIG. 8A.

FIGS. 8A and 8B show an alternate embodiment of a bridge 20B in accordance with the invention for stringed musical instruments 24. This bridge 20B is also top-mount style. That is, the base plate 30 thereof mounts on the top side 26 of the musical instrument 24 by means of, for example and without limitation, mounting screws 22 or the like.

This FIGS. 8A and 8B bridge 20B differs from the FIGS. 1-7 bridge 20 in about two respects, one a little more significant than the other. The more significant difference is, the elimination of the slots 42 in the base plate 30. The partitions 44 have been eliminated and hence what exists between the shoulders 39 of the base is one common cavity providing one common sliding surface. The cavity is open to the top and front sides 32 and 34 of the base plate 30, but walled-in by the rear wall 38 and the laterally-spaced shoulders 39. The plural bridge-adjustment assemblies 50 are allowed to slide rearward and forward but shoulder-to-shoulder to each other on this common sliding surface.

The other relatively more minor difference is the replacement of the set screws 64B with roll pins 64C as the operative bushing-retention provisions 64 on the intonation-adjusting sub-assemblies 58.

Figure 9A:
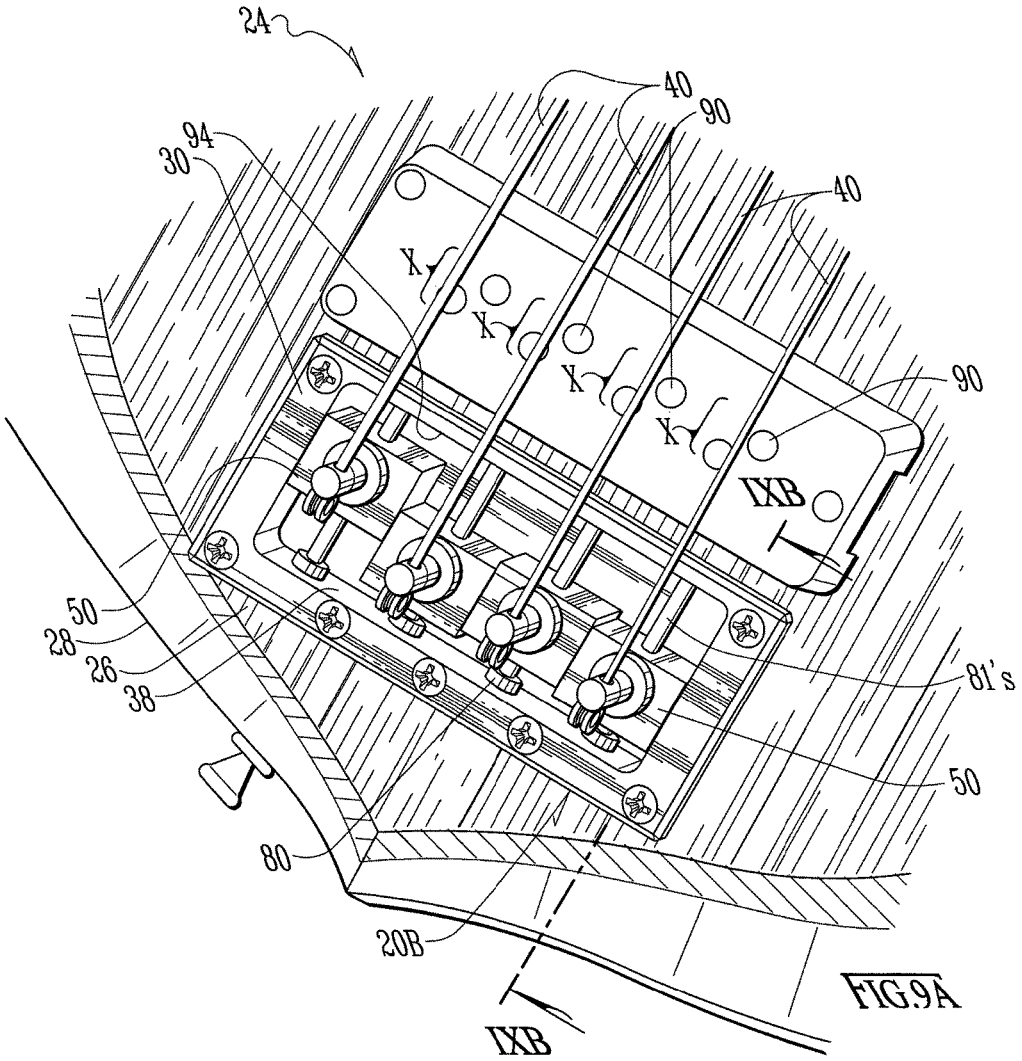
FIG. 9A is a perspective view comparable to FIG. 8A except showing an additional embodiment of a bridge in accordance with the invention for stringed musical instruments, except wherein this embodiment is mounted in a recessed pocket in the body of the guitar which presumably has to be routed out by a router or other like pocket producing tool or technique, and again this embodiment does not have the plural bridge-adjustment assemblies sliding longitudinally in dedicated slots that are divided by partitions as shown in FIG. 2, but instead the plural bridge-adjustment assemblies slide longitudinally past each other shoulder-to-shoulder in a common cavity.
Figure 9B:
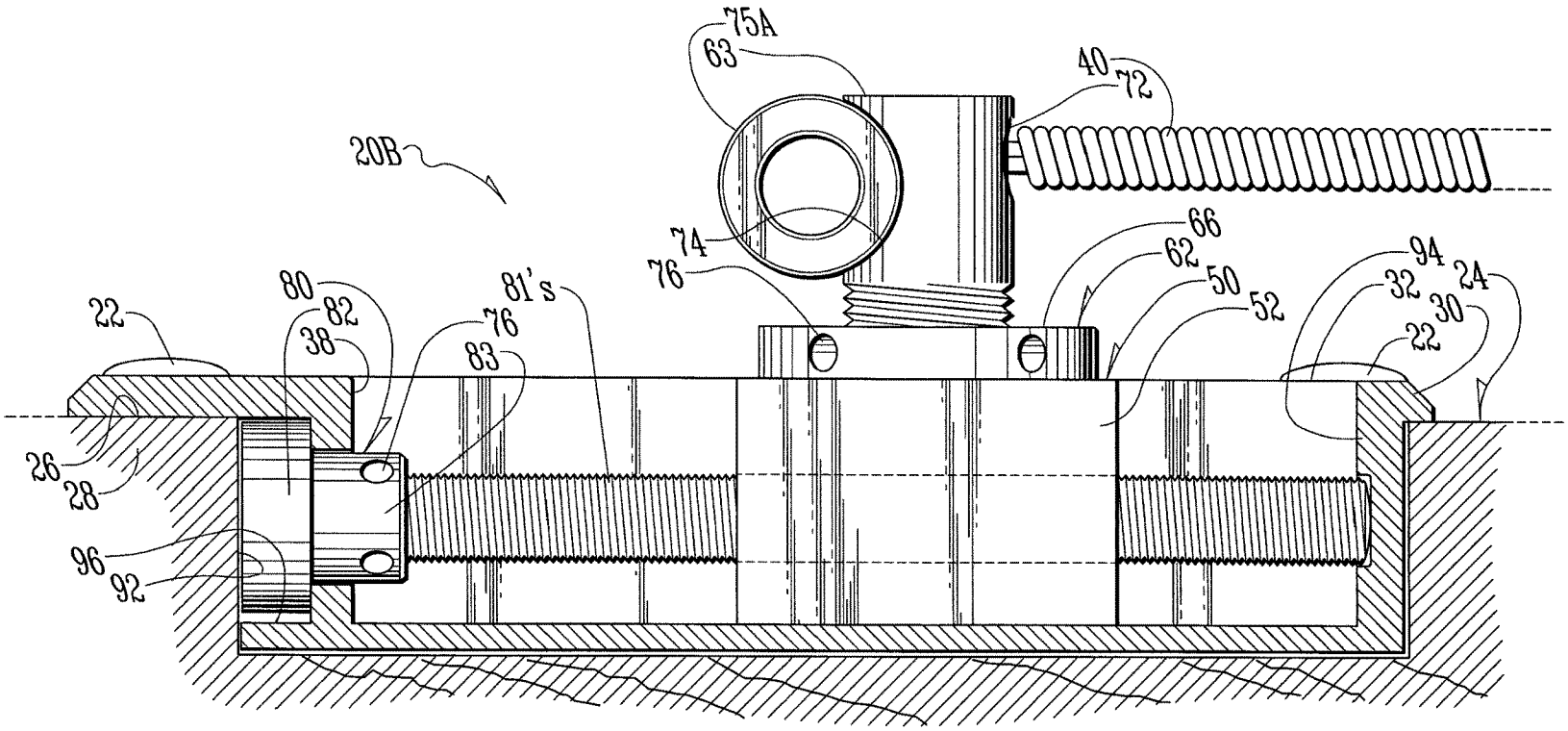
FIG. 9B is an enlarged-scale sectional view taken along line IXB-IXB in FIG. 9A.
Figure 10:
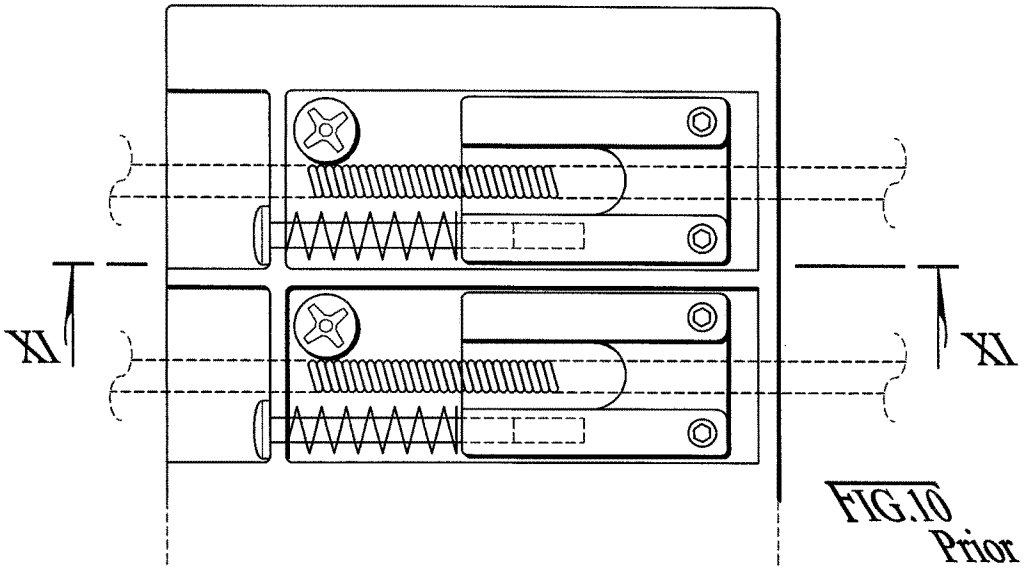
FIG.10 Prior Art
FIG. 10 is a top plan view of a bridge in accordance with the prior art for stringed musical instruments.
Figure 11:
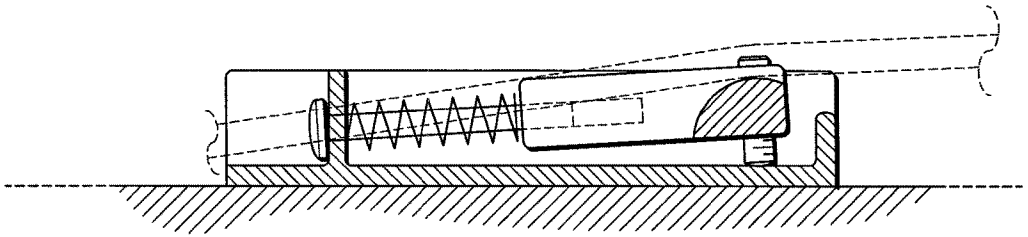
FIG.11 Prior Art
FIG. 11 is a sectional view taken along line XI-X1 in FIG. 10.

FIGS. 9A and 9B show an additional embodiment of a bridge 20C in accordance with the invention for stringed musical instruments 24. This FIGS. 9A and 9B bridge 20C is like the FIGS. 8A and 8B bridge 20B in eliminating the partitions —44 and thereby eliminating the slots 42. However, this bridge 20C differs from the previous two versions in two other respects.

This bridge 20C is mounted in a recessed pocket 92 in the body 28 of the guitar 24. This pocket 92 presumably has to routed out by a router or other like pocket producing tool or technique. So height-adjustability range of this bridge 20C should be able to drop the elevation of the instrument strings 40 until the strings 40 just barely clear the top side 26 of the stringed musical instrument 24. However, many owners of 'vintage' stringed musical instruments—which do not have such pockets—are understandably going to be reluctant to allow such pockets to be formed in their instruments just so as they can retro-fit their instrument to accept this recessed-mounted version of a bridge 20C in accordance with the invention.

Nevertheless, this configuration of the bridge 20C does afford a convenient way to retain the intonation-adjusting bushing 80 in free-to spin but otherwise axially locked position:—and, without retaining rings 64A, set screws 64B or roll pins 64C and the like.

This base plate 30 has a front wall 94. The rear wall 38 of the base plate 30 is formed with a countersunk through-hole 96. And, the intonation-adjusting bushing 80 is turned around such that the intonation-adjusting bushing 80's barrel portion 83 sticks out into the cavity of the base plate 30, and enlarged flange head 82 is accepted in the countersink portion of the countersunk through-hole 96. Hence the enlarged flange head 82 of the intonation-adjusting bushing 80 sits in a countersunk through-hole 96 for it in the rear wall 38 of the base plate 30. The retention provision for keeping the intonation-adjusting bushing 80 axially-locked in place while still allowing the intonation-adjusting bushing 80 to spin is merely the close fit between the rear wall 38 of the recessed-mounted base plate 30, and, the wall of the pocket 92 for the base plate 30 in the guitar 24. The enlarged flange head 82 is limited from translating forwardly by the countersink portion of the countersunk through-hole 96 and limited from translated rearwardly by the wall of the pocket 92 routed into the guitar body.

The drive screw 81's front end extends into a socket for it in the front wall 94 of the base plate 30. With the enlarged flange head 82 being axially locked as described above, the drive screw 81's front end is likewise axially locked in the socket for it. Hence the drive screw 81 is simply supported at its rear and front ends. Turning the drive screw 81 moves the block 52.

When the bridge 20C is mounted, only the barrel portion 83 of the intonation-adjusting bushing 80 is accessible to the user, and only inside the confines of the cavity in the base plate 30. Hence the barrel portion 83 has the socket holes 76 for the pin wrench 77.

It is an object of the invention to achieve several improvements for bridges 20 of stringed musical instruments 24, some of which objects can be described better in connection with examination of FIGS. 5A through 5D.

The terminal tackle 75 of the instrument strings 40 are secured to any of the bridges 20 in accordance with the invention by anchorage seats 74. The two examples shown here for terminal tackle 75 include for example and without limitation ball-style bead ends 75A, and, bullet ends 75B. The bridge-adjustment assemblies 50 in accordance with the invention provide an anchor seat 74 and string hole 72 for their respective instrument strings 40. The anchor seats 74 are configured for the terminal tackle 75 of the instrument strings 40 to seat tightly therein. The string holes 72 are configured to let the strings 40 pass therethrough directly from the seated terminal tackle 75 without the sidewalls of the string holes 40 touching or even brushing the string 40.

Again, the strings 40 pass through the respective string-hole 72 therefor from the anchorage seat 74 of the bridges 20 in accordance with the invention without touching—or even brushing—the sidewalls of the respective string hole 72. Thus the strings 40 extend free and clear of any interference from each one's tightly-seated terminal tackle 75 to the string 40's clearance above the electronic pick-ups 90 (or sound holes in the case of acoustic instruments). The strings 40 do not bend or kink over a saddle (or a groove in a saddle).

The relative anchorage seat 74 for the terminal tackle 75 of each string 40 is adjustable in two orthogonal directions relative the base plate 30 (and relative the instrument pick-ups 90 or sound holes of the respective musical instrument 24).

That is, the anchorage seat 74 can be adjusted in elevation by the height-adjusting sub-assembly 56. Additionally, the anchorage position (ie., anchorage seat 74) for the terminal tackle 75 can be adjusted for intonation by the intonation-adjusting sub-assembly 58.

As an aside, it is known that the head stock of a stringed musical instrument 24 will typically having tuning pegs for adjusting the tension on a string 40 and hence the tune of the string 40. However, the primary service of the bridge-adjusting assemblies 50—including each one's height-adjusting sub-assembly 56 and intonation-adjusting sub-assemblies 58—is not tuning service, but instead this.

Referring to FIG. 9A, assume that a span "X" of the instrument string 40 is believed to be an optimum span to center over the electronic pick-ups 90 (or sound holes in the case of acoustic instruments). The bridge-adjusting assemblies 50 allow the musician to move span "X" forwards and rearwards relative the electronic pick-ups 90 (or sound holes in the case of acoustic instruments). The bridge-adjusting assemblies 50 also allow the musician to move span "X" to a higher elevation or lower elevation relative the electronic pick-ups 90 (or sound holes in the case of acoustic instruments).

Thus, the relative anchorage seat 74 for the terminal tackle 75 of each string 40 is adjustable in two orthogonal directions relative the base plate 30 (and relative the instrument pick-ups 90 or sound holes of the respective musical instrument 24). These directions being, in reference to the directions introduced above, along front to rear axis, and along a top to "back" axis.

Whereas the invention has been described and illustrated in connection with a four string 40 musical instrument 24, this is done so for example and is non-limiting to adapting the invention for stringed musical instruments 24 of other string counts.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A bridge for a stringed musical instrument having a plural of instrument strings, wherein the bridge-ends of the instrument strings are provided with terminal tackle; said bridge comprising:

a base plate for mounting on the top of a stringed musical instrument or in a pocket in the top of a stringed musical instrument;

a plurality of bridge-adjusting assemblies, one each for each string, and each having an anchorage seat for the terminal tackle of the respective string;

wherein each bridge-adjusting assembly comprises an anchorage-seat height-adjusting sub-assembly and an anchorage-seat intonation-adjusting sub-assembly;

a plurality of anchors, one each for each bridge-adjusting assembly, each anchor provided with a through-bore extending between a front opening and rear opening in the anchor, wherein the anchorage seat for each anchor being provided proximate the rear opening, said through-bores being sized such that the respective anchors do not touch the strings except between the anchorage seats and the terminal tackle of the strings;

wherein each anchorage-seat height-adjusting sub-assembly comprises one respective anchor;

each anchor extends between a top and bottom end and comprises a cylindrical bottom portion formed with external thread proximate the bottom end; and the anchorage-seat height-adjusting sub-assembly further comprises a rotatable height-adjusting bushing provided with an internally threaded bore for driving the anchor and thereby the anchorage seat between height-adjusting extremes.

2. The bridge for a stringed musical instrument of claim 1, wherein:

said anchorage seats being formed to engage either a ball end-bead style of terminal tackle for a string or a bullet end-bead style of terminal tackle for a string.

3. A bridge for a stringed musical instrument having a plural of instrument strings, wherein the bridge-ends of the instrument strings are provided with terminal tackle; said bridge comprising:

a base plate for mounting on the top of a stringed musical instrument or in a pocket in the top of a stringed musical instrument;

a plurality of bridge-adjusting assemblies, one each for each string, and each having an anchorage seat for the terminal tackle of the respective string;

wherein each bridge-adjusting assembly comprises an anchorage-seat height-adjusting sub-assembly and an anchorage-seat intonation-adjusting sub-assembly;

each bridge-adjusting assembly further comprises a sliding block that slides between front and rear extremes; and each anchorage-seat intonation-adjusting sub-assembly comprises a drive shaft for driving the respective blocks between the front and rear extremes therefor;

each block carries one respective anchorage-seat height-adjusting sub-assembly;

a plurality of anchors, one each for each block, each anchor provided with a through-bore extending between a front opening and rear opening in the anchor, wherein the anchorage seat for each anchor being provided proximate the rear opening;

each anchorage-seat height-adjusting sub-assembly comprises one respective anchor;

each anchor extends between a top and bottom end and comprises a cylindrical bottom portion formed with external thread proximate the bottom end; and each block having a front sidewall and being provided with a bore in the front sidewall;

the anchorage-seat height-adjusting sub-assembly further comprises a rotatable height-adjusting bushing rotatably mounted in the respective bore in the front sidewall of the respective block therefor, each rotatable height-adjusting bushing provided with an internally threaded bore for driving the anchor and thereby the anchorage seat between height-adjusting extremes.

4. The bridge for a stringed musical instrument of claim 3, wherein:

the base plate is formed with flanking shoulders between laterally-spaced extremes and a series of laterally-spaced partitions between the shoulders to thereby define a plurality of slots that extend along respective front to rear axes generally parallel to the strings and are provided with front openings for clearance of the strings;

each block being in a dedicated slot therefor and is thereby kept aligned.

5. The bridge for a stringed musical instrument of claim 3, wherein:

the base plate is formed with a rear wall and flanking shoulders that are disposed at laterally-spaced extremes relative each other thereby forming a common cavity in the base plate forming a common sliding surface for the blocks surrounded by the rear wall and flanking shoulders;

each block comprising a pair of laterally-spaced shoulders and slide side-by-side each other on the common sliding surface therefor in the common cavity, the laterally-outermost shoulders of the laterally-outermost blocks sliding side-by-side relative to the shoulders of the base plate, all the other shoulders of blocks sliding side-by-side relative an adjacent block's shoulder and thereby keeping mutually self-aligned.

6. The bridge for a stringed musical instrument of claim 3, wherein:

wherein each block has an internally-threaded through-bore extending along a rear to front axis generally parallel to the strings; and each drive shaft comprises drive screw threaded into the respective internally-threaded through-bores of the respective blocks.

7. A bridge for a stringed musical instrument having a plural of instrument strings, wherein the bridge-ends of the instrument strings are provided with terminal tackle; said bridge comprising:

a base plate for mounting on the top of a stringed musical instrument or in a pocket in the top of a stringed musical instrument;

a plurality of bridge-adjusting assemblies, one each for each string, and each having an anchorage seat for the terminal tackle of the respective string;

wherein each bridge-adjusting assembly comprises an anchorage-seat height-adjusting sub-assembly and an anchorage-seat intonation-adjusting sub-assembly;

each bridge-adjusting assembly further comprises a sliding block that slides between front and rear extremes; and each anchorage-seat intonation-adjusting sub-assembly comprises a drive shaft for driving the respective blocks between the front and rear extremes therefor;

wherein the base plate has a rear sidewall in front of which the blocks slide between the respective front and rear extremes thereof, the rear sidewall being formed with a series of bores;

each drive shaft comprises a drive screw affixed to one respective block and extending rearwardly therefrom to extend through a respective bore in the rear sidewall;

a plurality of intonation-adjusting bushings mounted in a respective one of the bores in the rear sidewall of the base plate, each intonation-adjusting bushing having an internally-threaded through-bore for engaging a respective one of the drive shafts and for driving the respective block between the front and rear extremes therefor.

8. The bridge for a stringed musical instrument of claim 7, further comprising:

a bushing-retention provision comprising any of retaining ring, a set screw or a roll pin.

9. The bridge for a stringed musical instrument of claim 7, further comprising:

each bushing comprises either a hex head or at least one or two flats to accept wrenches, or one or more sockets to accept insertion tools.

* * * * *